United States Patent [19]

Lassiter

[11] Patent Number: 5,040,502

[45] Date of Patent: Aug. 20, 1991

[54] CRANKLESS INTERNAL COMBUSTION ENGINE

[76] Inventor: Will M. Lassiter, 1703 Deep River Rd., High Point, N.C. 27260

[21] Appl. No.: 544,846

[22] Filed: Jun. 27, 1990

[51] Int. Cl.[5] ..... F02B 75/32

[52] U.S. Cl. ..... 123/197 AC; 74/579 E

[58] Field of Search ..... 123/197 AC; 74/595, 74/598, 579 E

[56] References Cited

U.S. PATENT DOCUMENTS

| | | | |
|---|---|---|---|
| 1,505,856 | 8/1924 | Briggs . | |
| 1,667,213 | 4/1928 | Marchetti . | |
| 2,407,859 | 9/1946 | Wilson . | |
| 2,757,547 | 8/1956 | Julin . | |
| 3,693,463 | 9/1972 | Garman | 74/38 |
| 3,886,805 | 6/1975 | Koderman | 123/197 AC |
| 3,916,866 | 11/1975 | Rossi | 123/197 R |
| 4,078,450 | 3/1978 | Vallejos | 123/197 AC |
| 4,085,628 | 4/1978 | McWhorter | 123/197 AC |
| 4,363,299 | 12/1982 | Bristol | 123/197 AB |
| 4,406,256 | 9/1983 | Akkerman | 123/78 E |
| 4,465,042 | 8/1984 | Bristol | 123/197 |
| 4,466,387 | 8/1984 | Perry | 123/41.37 |
| 4,622,864 | 11/1986 | Fetouh | 123/197 AC |
| 4,712,518 | 12/1987 | Johnson | 123/197 AC |
| 4,807,577 | 2/1989 | Koutsoupidis | 123/197 AC |
| 4,899,705 | 2/1990 | Reed | 123/197 AC |
| 4,909,204 | 3/1990 | Machida | 123/197 AC |

*Primary Examiner*—David A. Okonsky

[57] ABSTRACT

An internal combustion engine is provided by reciprocating force is translated to rotational motion without the use of a conventional crankshaft. A series of crank bearings are aligned linearly whereby piston rods disposed therebetween provide rotational motion for a power take-off or the like.

12 Claims, 2 Drawing Sheets

CRANKLESS INTERNAL COMBUSTION ENGINE

BACKGROUND OF THE INVENTION

1. Field of the Invention

The invention herein pertains to internal combustion engines and particularly to a mechanism whereby the reciprocating movement of the pistons is converted to rotational movement without the use of a conventional crankshaft.

2. Description Of The Prior Art And Objectives Of The Invention

Many conventional internal combustion engines have cylinders with internal reciprocating pistons. These pistons, by use of an enlongated connecting rod are joined at their distal ends to a crankshaft. As the fuel within each cylinder is ignited the pistons are forced downwardly thereby imparting torque to the crankshaft causing rotation thereof and delivering power to a take-off. Depending on the exact mechanics and dimensions employed, various engine efficiencies and horsepower are available. Also, in such conventional internal combustion engines, significant power losses are realized due to the transformation of reciprocating to rotating motion. In order to improve overall internal combustion engine efficiency, various attempts have been made in the past to increase the mechanical efficiency of engine cranks and crankshafts. Some prior art patents have attempted to reduce the frictional losses of the crank mechanisms. Others have attempted to eliminate conventional connecting rods and crank mechanisms to increase efficiency and torque output while reducing frictional losses. However, most attempts in the past have provided many additional engine parts and complexities which create unique problems of their own. Hence the need for an efficient, durable and simple internal combustion engine has remained.

Therefore, with the aforesaid disadvantages and problems associated with conventional internal combustion engines the present invention was conceived and one of its objectives is to provide an internal combustion engine which can be relatively easily produced and assembled but which will be economical to operate.

It is yet another objective of the present invention to provide an internal combustion engine which will eliminate the conventional mechanical crankshaft and the friction associated therewith.

It is still another objective of the present invention to provide an internal combustion engine which is durable and which develops appropriate horsepower for its dimensions.

It is yet another objective of the present invention to provide an internal combustion engine in which power is readily converted from a reciprocating to rotational movement in a highly efficient manner through the use of crank bearings.

Various other objectives and advantages of the present invention become apparent to those skilled in the art as a more detailed description is presented below.

SUMMARY OF THE INVENTION

The aforesaid and other objectives are realized by providing an internal combustion engine having a plurality of crank bearings attached to piston rods disposed therebetween. An elongated connecting member is affixed proximate its midpoint to a piston rod, and each end of the connecting member is rotatably affixed to a different crank bearing. Thus, upon reciprocation of the pistons a rotational motion with reduced friction is imparted to the connecting members which in turn drives a power take-off positioned outside a terminal crank bearing.

DESCRIPTION OF THE PREFERRED EMBODIMENT

Figure 1:
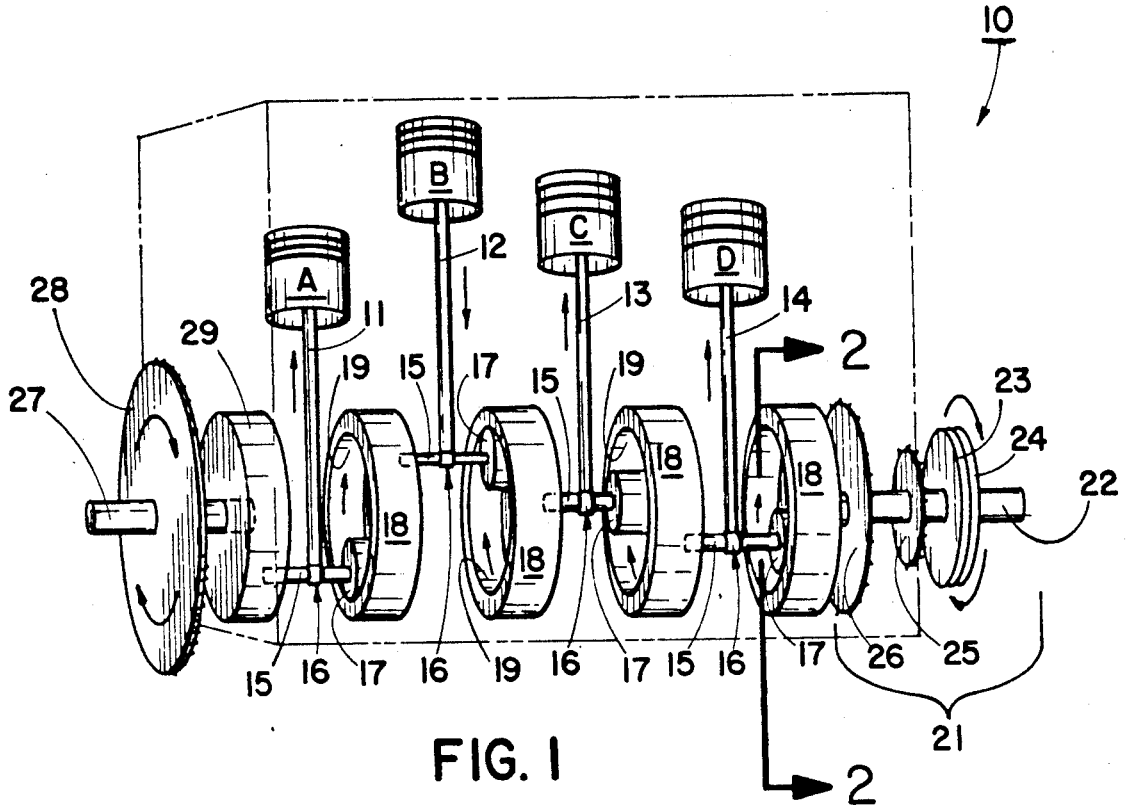
FIG. 1 demonstrates a crankless internal combustion engine of the invention employing a series of four pistons and five crank bearings.
Figure 2:
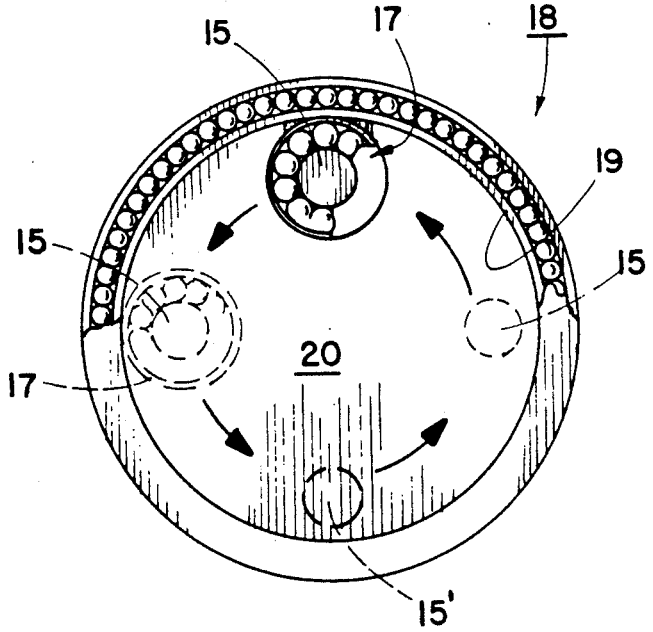
FIG. 2 illustrates a crank bearing of FIG. 1 along lines 2—2.

The preferred form of the invention is illustrated in FIGS. 1 and 2 utilizing a four cylinder internal combustion engine, it being understood that substantially only the inventive features are illustrated without regard to the fuel, exhaust, timing, electrical, lubricating or valve assemblies which are not pictured herein for the sake of brevity and clarity.

As presented in FIG. 1, the engine block is of the linear "straight" type with pistons joined at their distal ends to a cylindrical connecting member which is affixed at each end thereof to a different crank bearing. The preferred embodiment as shown in FIG. 1 includes one end of the connecting member fitted within a relatively small roller bearing as shown in FIG. 2, said small bearing fixed inside of the internal race of a larger crank bearing. Also, behind the smaller roller bearing (FIG. 2) is a crank bearing plate which is also joined to the internal crank bearing race. The opposite end of another connecting member is affixed to said plate, within an opening therein whereby the small internal bearing, the crank plate and the second connecting member all rotate in unison with the first connecting member. As would be understood from FIG. 1, as the series of pistons reciprocate, each of said connecting members is driven and rotational motion is delivered to the power take-off.

DETAILED DESCRIPTION OF THE DRAWINGS AND OPERATION OF THE INVENTION

For a better understanding of the crankless mechanism of the invention, turning now to the drawings, FIG. 1 demonstrates in schematic fashion a linear or straight four cylinder internal combustion engine 10 whereby piston A is shown in its lower most position, piston B at the apex of its cycle, piston C somewhat below piston B and piston D slightly lower than piston C. As would be understood the firing sequence and piston alignments are shown herein for illustrative purposes and are not to be considered as exact configurations. As further shown in FIG. 1, pistons A, B, C and D are joined respectively to piston rods 11, 12, 13 and 14. Each piston rod is connected at its distal end to a cylindrical connecting member 15. Piston rods 11, 12, 13 and 14 are rotatably joined at 16 to their respective cylindrical connecting members 15 by bearings or otherwise. One end of each connecting member 15 is rotatably positioned within bearing 17, shown in greater detail enlarged in FIG. 2.

Connecting member bearing 17 seen in FIG. 2 is permanently affixed within crank bearing 18 by rigid attachment such as by welding to internal race 19. On the other or "closed" side of bearing 18, plate 20 is also rigidly affixed to internal race 19. Thus, as would be understood, as a particular cylinder fires such as piston A, piston A is driven downwardly thereby imparting rotational motion to race 19 through connecting member 15, thereby in turn imparting rotational motion to a subsequent connecting member 15' (as illustrated in FIG. 2 for clarity purposes) to likewise rotate power take-off 21. Power take-off 21 comprises forward engine shaft 22 having mounted thereon fan belt pulleys 23, 24, distributor gear 25, and timing gear 26. Rear engine shaft 27 likewise, as shown in FIG. 1 (in abbreviated fashion) has flywheel 28 joined thereto. Rear engine shaft 27 is joined to crank bearing 29 which comprises a modified form of crank bearing 18. Rear engine shaft 27 rotates simultaneously with forward engine shaft 22.

As earlier discussed, engine 10 configuration as demonstrated in FIG. 1 is merely a schematic representation and those skilled in the art will realize that various other cylinder configurations such as the common "V" type could also be employed with more or less pistons than those shown, depending on the particular power and size requirements needed. As hereinbefore mentioned, only the novel features of internal combustion engine 10 are illustrated without regard to the conventional fuel, lubrication (circulating or spray type), valve, electrical, exhaust, timing and other necessary features as required for actual engine operation.

Figure 3:
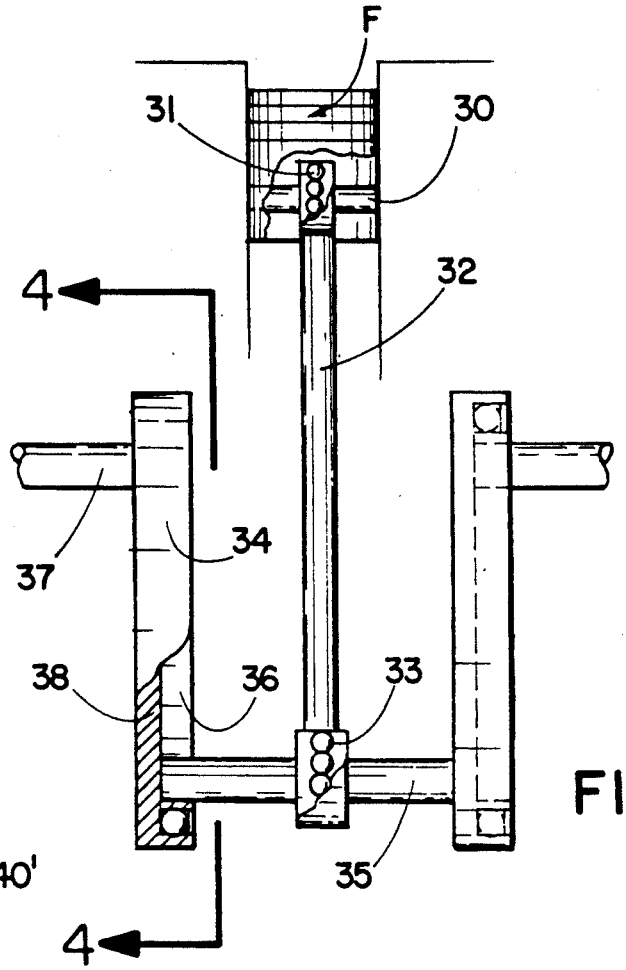
FIG. 3 illustrates a cross-sectional view the second embodiment of the piston rod of the connecting member joined to a pair of crank bearings.
Figure 5:
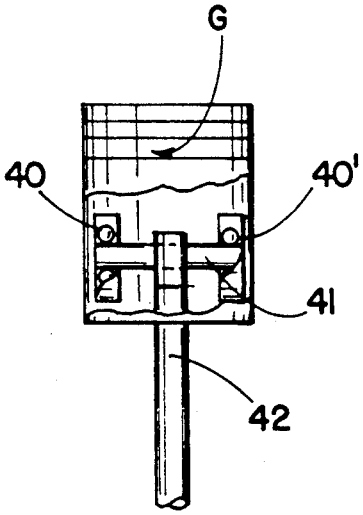
FIG. 5 shows yet another configuration of the piston rod attached to the piston.
Figure 4:
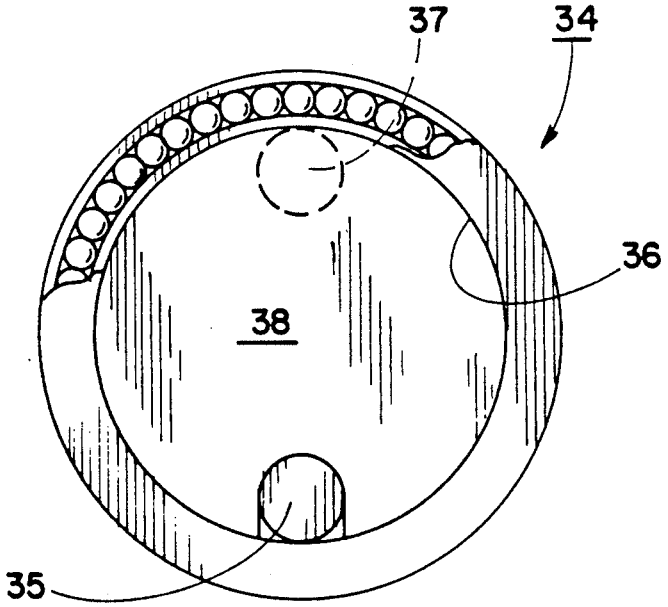
FIG. 4 illustrates the crank bearing of FIG. 3 along lines 4—4.

In FIG. 3, piston F is featured with wrist pin 30 supported in proximal rod bearing 31 which is affixed to piston rod 32. Distal rod bearing 33 is likewise joined to piston rod 32 at the distal end thereof. As shown along lines 4—4 of bearing 34 of FIG. 3, FIG. 4 depicts a cross-sectional view of connecting member 35 rigidly affixed to race 36 of bearing 34 with the opposite end of a subsequent connecting rod 37 mounted in bearing plate 38. Rod 37 may also be joined to race 36 directly, thereby eliminating the need for plate 38. In FIG. 5, yet another piston G is presented having a pair of wrist pin bearings 40, 40' which rotatably maintain wrist pin 41 therein. Piston rod 42 is rigidly affixed to wrist pin 41 and as shown the pivoting motion between piston G and piston rod 42 is allowed due to wrist pin bearings 40, 40'.

While various bearing and rigid connections are shown in the engine mechanisms of FIGS. 1–5, it has been found that a crankless engine with crank bearings can be provided which is efficient, reduces internal friction, is powerful and long lasting and which eliminates many problems and disadvantages of internal combustion engines having conventional crankshafts.

The illustrations and examples provided herein are for explanatory purposes and are not intended to limit the scope of the appended claims.

I claim:

1. In an internal combustion engine of the type employing a reciprocating piston with a piston rod for imparting rotary motion to a power take-off, the improvement comprising: a plurality of pistons, a plurality of piston rods, each of said piston rods joined to one of said pistons, a plurality of crank bearings, each of said crank bearings comprising a crank bearing plate, a plurality of linear connecting members, each piston rod joined to a different connecting member, each end of each of said connecting members joined to a different crank bearing, with one end of said connecting member joined to a crank bearing plate whereby reciprocating said pistons causes said connecting members to rotate, thereby rotating said power take-off.

2. An internal combustion engine as claimed in claim 1 wherein said crank bearings comprise roller bearings.

3. An internal combustion engine as claimed in claim 1 wherein said crank bearings comprise a pair of roller bearings.

4. An internal combustion engine as claimed in claim 1 wherein each of said connecting members comprises a cylindrical shaft, a piston rod, said rod bearingly joined to said cylindrical shaft.

5. An internal combustion engine as claimed in claim 1 wherein said connecting members are rigidly joined to said crank bearing plates.

6. An internal combustion engine as claimed in claim 1 wherein said piston rods are bearingly joined to said pistons.

7. An internal combustion engine as claimed in claim 1 comprising four pistons.

8. An internal combustion engine as claimed in claim 1 comprising five crank bearings.

9. An internal combustion engine as claimed in claim 1 wherein each of said crank bearings comprise a connecting member bearing.

10. An internal combustion engine as claimed in claim 1 wherein said crank bearing plates are rotatably joined to said crank bearings.

11. An internal combustion engine as claimed in claim 10 and including connecting member bearings, said connecting member bearings joined to said crank bearing plates.

12. In an internal combustion engine of the type employing a reciprocating piston with a piston rod for imparting rotary motion to a power take-off, the improvement comprising: a plurality of pistons, a plurality of piston rods, each of said piston rods bearingly joined to one of said pistons, a plurality of crank bearings, each of said crank bearings comprising a crank bearing plate, an internal bearing race, said plate affixed to said race, a roller bearing, said roller bearing fixed within said internal race, a plurality of cylindrical connecting members, each piston rod bearingly joined to a different connecting member, one end of each of said connecting members joined to a different crank bearing plate, and the opposite end of each of said connecting members joined to a different one of said roller bearings, said crank bearings positioned in a linear configuration, each of said pistons disposed between a different pair of crank bearings, alternate connecting members disposed at different radial positions on successive crank bearings, whereby reciprocating said pistons causes said connecting members to rotate thereby rotating said power take-off.

* * * * *